US005881523A

United States Patent [19]

Quatrochi, Jr.

[11] Patent Number: 5,881,523

[45] Date of Patent: Mar. 16, 1999

[54] MECHANICAL PACKERS FOR CONCRETE REPAIR

[76] Inventor: Rosario Quatrochi, Jr., 925 Boutell, Grand Blanc, Mich. 48439

[21] Appl. No.: 988,276

[22] Filed: Dec. 10, 1997

[51] Int. Cl.[6] ..... E02D 37/00

[52] U.S. Cl. ..... 52/514.5; 52/742.16

[58] Field of Search ..... 52/514.5, 742.16, 52/742.1; 405/269

[56] References Cited

U.S. PATENT DOCUMENTS

| | | | |
|---|---|---|---|
| 3,557,563 | 1/1971 | Stevens | 52/742.16 X |
| 5,027,568 | 7/1991 | Schmidt | 52/514.5 |
| 5,033,952 | 7/1991 | Haug | 52/742.16 X |
| 5,476,344 | 12/1995 | Nordvall . | |

*Primary Examiner*—Creighton Smith
*Attorney, Agent, or Firm*—Reising, Ethington, Learman & McCulloch

[57] ABSTRACT

A mechanical packer (10) for injecting repair compound into a damaged concrete structure (13) comprises a rigid insertion portion (20) having distal (24) and proximal ends (26). A feed stem (22) that can be broken off is attached to the proximal end (26) of the insertion portion (20). A passageway (40) allows the repair compound to pass through the packer and into the damaged structure. The packer (10) further includes a check valve (42) positioned in the passageway (40) that allows the repair compound to remain under pressure in the damaged structure, until it cures, even after the feed stem has been broken off.

15 Claims, 1 Drawing Sheet

MECHANICAL PACKERS FOR CONCRETE REPAIR

TECHNICAL FIELD

The present invention relates to mechanical packers for injecting liquid repair compound into the cracks of a damaged concrete structure. Specifically, the present invention relates to mechanical packers which have a check valve adapted to keep the liquid repair compound under pressure while it is setting. Further, the invention relates to a method for repairing a damaged concrete structure.

BACKGROUND ART

Mechanical packers, or packers, are commonly used to inject liquids under pressure into cracked and damaged concrete to fill voids thereby stopping leaks and further degradation of the concrete. The repair compounds injected usually are an epoxy or a polyurethane that set or harden over time in the voids in the damaged concrete. Metallic packers are typically used in medium to high pressure applications where the concrete may be severely damaged while plastic packers are typically used in low pressure applications where the damage to the concrete is less severe.

In many instances, the packer has a feed tube that extends a distance from the concrete structure after the packer is inserted. The packer either remains in the structure, or is removed only after the repair compound has set. One such packer, shown in U.S. Pat. No. 5,476,344 to Nordvall issued on Dec. 19, 1995, discloses a concrete injection mechanism with an expandable end portion. The expandable end portion, which is located in a pre-drilled bore in the concrete, works in conjunction with a non-return valve. As a liquid repair material is forced under pressure into the injection mechanism, the diameter of the expandable end increases before the non-return valve opens to release the pressurized material into the concrete, thus securing the injection mechanism in the bore. However, the feed pipe cannot be disconnected and the outer end removed until the material is allowed to harden, as the repair material would no longer be held under pressure.

SUMMARY OF THE INVENTION AND ADVANTAGES

According to the present invention, there is provided a mechanical packer for injecting repair compound into damaged concrete that comprises a rigid insertion portion having distal and proximal ends. A feed stem is attached to the proximal end of the insertion portion. The feed stem includes a breakaway end. The insertion portion and feed stem have a passageway which runs their length. The packer further includes a check valve positioned in the passageway between the breakaway end of the feed stem and the distal end of the insertion portion. The check valve is adapted to allow the flow of the repair compound through the passageway from the feed stem to the distal end and prevent the flow of repair compound through the passageway from the distal end to the feed stem.

Accordingly, one advantage of the present invention is to provide a mechanical packer that allows the feed stem to be broken away from the insertion portion before the repair compound has hardened while maintaining the repair compound in the damaged area of the concrete under pressure.

Another advantage of the present invention is to provide a unitary structure and method that allow the repair compound to be maintained in the damaged area after the feed of such material has been discontinued.

Yet another advantage of the invention is to provide a rigid insertion portion that can create enough frictional force to sufficiently affix itself within the drill hole while the repair compound is injected into the concrete.

Another advantage of the present invention is to provide a method of repairing concrete when repair material is injected under external pressure into a damaged area in a concrete structure through a mechanical packer and retaining the mechanical packer in the structure under pressure even after the external pressure has been removed.

BRIEF DESCRIPTION OF THE DRAWINGS

Other advantages of the present invention will be readily appreciated as the same becomes better understood by reference to the following detailed description when considered with the accompanying drawings wherein.

DETAILED DESCRIPTION OF THE DISCLOSURE

Figure 1:
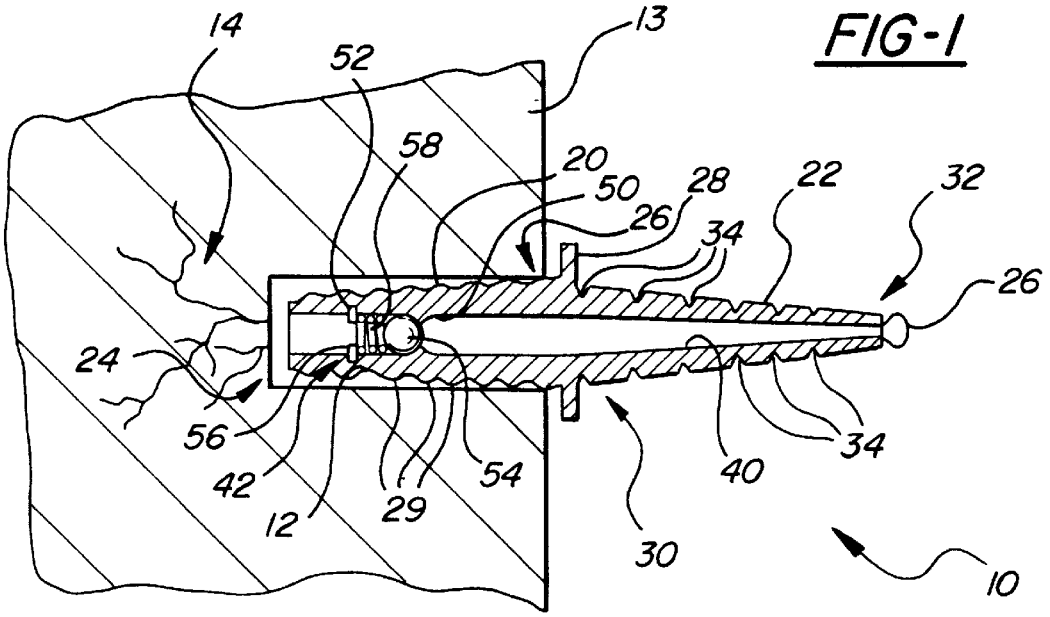
FIG. 1 is a cross sectional view of the preferred embodiment of the present invention.
Figure 2:
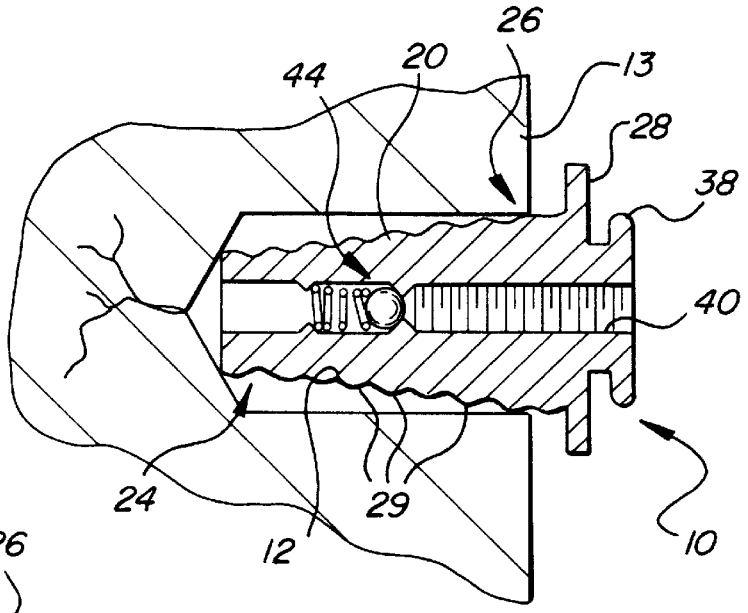
FIG. 2 is a cross sectional view of an alternative embodiment of the present invention having both a button head connection and a threaded connection.
Figure 3:
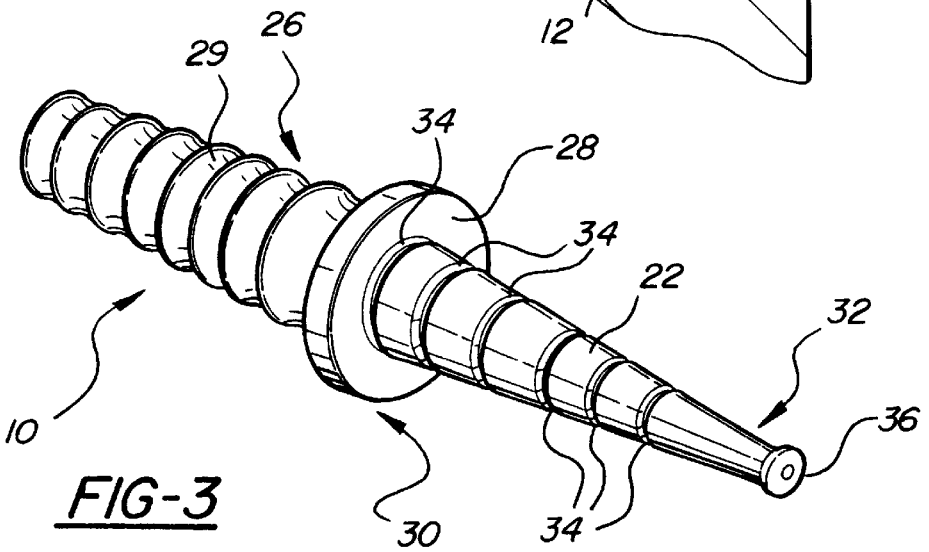
FIG. 3 is a perspective view of the preferred embodiment of the invention.

A mechanical packer adapted for use in concrete repairs is generally shown at 10 in FIGS. 1 through 3. The mechanical packer 10 is designed for use in hole 12 of a damaged area 14 of a concrete structure 13. The mechanical packer 10 comprises a rigid insertion portion 20 and a feed stem 22. The insertion portion 20 includes a distal end generally indicated at 24 and a proximal end generally indicated at 26. Although not necessary, a base or shoulder 28 that comprises an annular flange may be affixed to the proximal end 24 of the insertion portion 20. Furthermore, the base 28 may provide a surface that can be used to drive the packer 10 into the hole 12. The base 28 is thin enough so that it may be driven into the hole 12 if necessary to obtain a tight fit between the insertion portion 20 and hole 12.

The insertion portion 20 has a generally circular cross-section and is preferably tapered from the proximal end 26 to the distal end 24. That is, the cross sectional area of the proximal end 26 is greater than the cross sectional area at the distal end 24. This aids in installation of the insertion portion 20 into the hole 12. The outer periphery of the insertion portion 20 preferably has a ribbed surface 29. The taper of the insertion portion 20 in conjunction with the ribbed surface 29 increase the force between the packer 10 and the hole 12 and allow the repair material to be injected into the damaged area under pressure without the packer 10 becoming dislodged from the hole 12. The taper is gradual thereby maximizing the number of ribs 29 in contact with the hole 12. Thus, the unit pressure is increased as a result of the ribs 29 filling any imperfections in the hole 12. That is, the combination of the taper and the ribbed surface allows the insertion portion 20 to engage the hole 12 securely so that the repair material can be retained under pressure while it cures.

In the preferred embodiment (FIGS. 1 and 3), the feed stem 22 has a generally circular cross-section and includes a breakaway end 30 and a feed end 32. The breakaway end 30 is attached to the base 28 of the insertion portion 20. The breakaway end 30 further includes at least one annular notch 34 about its circumference creating a weakened area. The annular notch 34 facilitates the feed stem 22 being sheared from the proximal end 26 of the insertion portion 20 when a sufficient force having a perpendicular component to the feed stem 22 is applied. By having more than one annular notch 34, the feed stem 22 may be broken away from the proximal end 26 at several points along its length. Thus if the packer 10 is driven deeply into the hole 12 such that the annular notches 34 close to the breakaway end 30 are inaccessible, the feed stem 22 can be broken off at an annular groove 34 closer to the feed end 32.

In the preferred embodiment, the insertion portion 20 and the feed stem 22 may form a unitary one-piece structure. The packer 10 is preferably made from a plastic or similar material which would facilitate the feed stem 22 shearing away from the insertion portion 20 when struck with a moderate amount of force. By moderate amount of force it is meant a force capable of being generated by someone striking the feed stem with a hammer or similar hand tool.

The feed end 32 is adapted to be attached to a feed line (not shown) carrying the repair compound. The feed end 32 may utilize a zerk fitting 36, as shown in FIG. 1, or a button head 38 (as is known in the art), as shown in FIG. 2. Although the feed stem is shown tapered from the base 28 to the zerk fitting 36, it is to be understood that the feed stem may be have a uniform cross sectional area along its length. It is merely desirable that the feed stem have a configuration that is suited for the type of fitting to be used at the feed end and to permit the feed stem to be broken off if desired. It is not necessary that the feed stem 22 have any sort of check valve mechanism such as the zerk fitting.

In each of the embodiments, the feed end 32 and insertion portion 20 define a passageway 40 running through the packer 10 along its axis to the distal end 24 of the insertion portion 20. The passageway 40 permits repair compound to be injected through the packer 10 and into the concrete structure 13. The passageway 40 contains a check valve generally indicated at 42 to control the flow of repair compound.

The check valve 42 is located between the breakaway end 30 of the feed stem 22 and the distal end 24 of the insertion portion 20. The check valve 42 is oriented such that the repair compound when injected into the packer 10 is permitted to pass through the passageway 40 and out the distal end 24 of the insertion portion into the damaged area 14 of the concrete structure 13. The repair compound is prevented from flowing from the distal end 24 of the insertion portion 20 back towards the feed stem 22. Hence, having the check valve 42 oriented between the breakaway end 30 of the feed stem 22 and the distal end 24 of the insertion portion 20 permits the feed line to be disconnected and/or the feed stem 22 broken away from the insertion portion 20 immediately after the repair compound is injected into the damaged area 14. Thus, there is no need to wait until the repair compound has set or hardened before disconnecting the feed line or breaking off the feed stem 22 of the packer 10.

Use of a ball valve is contemplated although any suitable check valve may be utilized. As illustrated in FIG. 2, a pre-packaged check valve unit generally indicated at 44 may be inserted into the passageway 40 and held in place by any known retaining method. Also, as shown in FIG. 1, the check ball valve components may be individually inserted into the passageway 40. To accomplish this, one embodiment comprises a passageway 40 including an annular ridge 50 and an annular groove 52. A check ball 54 is positioned to abut the annular ridge 50 and a retaining clip 56 is inserted into the annular groove 52. Disposed between the retaining clip 56 and check ball 54 is a spring SB which is seated on the retaining clip 56 and engages the check ball 54 into abutting relationship with the annular ridge 50.

The spring 58 normally biases the check ball 54 against the annular ridge 50 to provide a seal therebetween. When repair compound is injected into the concrete structure 13 under external pressure the external pressure causes the check ball 54 to move against the biasing of the spring 58 to allow the repair compound into the concrete structure. When enough repair compound has been injected into the concrete structure (at this point the repair compound is under pressure in the concrete structure), the external pressure is removed and the check ball 54 seats against the flange 50 to prevent the repair compound from passing therethrough. Thus, the check ball 54 seated against the flange 50, holds the repair compound under pressure in the concrete structure even after the external pressure is removed. The check valve unit 44 of the alternative embodiment (FIG. 2) operates to hold the repair material in the concrete structure in the same manner as described above.

It is to be understood that the use of a feed stem 22 is not necessary, or if a feed stem is used it need not be capable of being broken off. For example, as shown in the alternative embodiment of FIG. 2, a packer having a button head 38 attached to the proximal end 26 of the insertion portion 20 would simply utilize the check valve 44 between the button head 38 and the distal end 24 of the insertion portion 20. Also, a portion of the passageway 40 may be threaded so that the feed line can threadingly engage the packer 10. Thus, the feed line may still be disconnected from the packer 10 before the repair compound has hardened or set as it will still remain under pressure behind the check valve 44. Hence, a packer 10 is provided which does not require an exposed check valve such as a zerk fitting extending from the proximal end 26. The feed stem 22 can be broken off in the work environment before the repair compound has hardened under pressure.

In operation, a hole 12 is drilled in a concrete structure 13 in a manner known in the art in a damaged area 14 of the concrete structure 13. The packer 10 is then inserted into the hole 12 by striking the base 28, or if a base is not used, any suitable portion of the packer, sufficiently so that when the repair compound is injected under pressure the packer will not become dislodged from the hole. The ridges 29 on the insert portion, as well as the tapering thereof allow a tight fit between the concrete structure 13 and the packer 10. The ridges 29 help maintain the packer 10 in the concrete structure 13 by filling imperfections in the hole 12.

Instead of striking the packer directly with a hammer or like tool, a tool may be used to engage the base 28 of the packer 10 and the tool can then be struck with a hammer or the like so that the risk of damage to the packer during installation can be reduced. A feed line (not shown) is attached to a fitting (button head, zerk, threaded, or the like) on the packer 10 so that repair compound may be injected through the packer 10 and into the damaged area 14.

External pressure is applied to the repair compound to force the material into the damaged area 14 of the concrete structure 13. The external pressure causes the check ball 54 to move against the biasing of the spring 58 to permit the repair compound into the damaged area 14. The external pressure is not sufficient to dislodge the packer 10 from the concrete structure 13. Once a sufficient amount of repair compound has been injected into the concrete structure under pressure, the feed line is disconnected and/or the feed stem 22 of the packer 10 is broken off at a suitably accessible annular groove 34, thus permitting the repair compound to harden or set and reinforce the concrete. Disconnecting the feed line and/or breaking off the feed stem 22 removes the external pressure from the repair compound which causes the check ball 54 to engage the flange 50 thereby holding the repair compound under pressure in the concrete structure even after the external pressure is removed.

The invention has been described in an illustrative manner, and it is to be understood that the terminology which has been used is intended to be in the nature of word of description rather than limitation.

Obviously, many modifications and variations of the present invention are possible in the light of the above teachings. It is, therefore, to be understood that within the scope of the appended claims the invention may be practiced otherwise than specifically described.

I claim:

1. A mechanical packer adapted for injection of a repair compound in damaged concrete structures comprising:

a rigid insertion portion having a distal end and a proximal end;

a feed stem attached to said proximal end of said insertion portion, said feed stem having a breakaway end;

said insertion portion and said feed stem defining a passageway therethrough; and a check valve positioned in said passageway between said breakaway end of said feed stem and said distal end of said insertion portion, said check valve adapted to allow the flow of the repair compound through said passageway from said feed stem to said distal end and to prevent the flow of the repair compound through said passageway from said distal end to said feed stem.

2. The mechanical packer of claim 1 wherein said rigid insertion portion and said feed stem comprise a unitary structure.

3. The mechanical packer of claim 2 wherein said unitary structure is a plastic material.

4. The mechanical packer of claim 1 wherein said insertion portion further comprises an outer surface having ribs thereon adapted to retain said insert portion in said concrete structure.

5. The mechanical packer of claim 4 wherein said outer surface is tapered towards said distal end of said insertion portion.

6. The mechanical packer of claim 1 wherein said check valve is a ball valve.

7. The mechanical packer of claim 1 wherein said feed stem defines a circumference, said breakaway end of said stem having at least one weakened area about said circumference whereby said stem when struck by a force component perpendicular to said stem will break at substantially said breakaway end.

8. The mechanical packer of claim 7 wherein said feed stem further comprises a feed end opposite aid breakaway end, said feed end adapted to be connected to a feed line whereby the repair compound is injected through said passageway and into said damaged concrete structure.

9. The mechanical packer of claim 1 further comprising a base adapted to abut a surface of the concrete structure, said base attached to said proximal end of said insertion portion, said breakaway end of said feed stem attached to said base, and said insertion portion, said base, and said feed stem defining said passageway therethrough.

10. A mechanical packer adapted for use for injection of a repair compound in damaged concrete structures comprising:

a rigid insertion portion, said insertion portion having a passageway therethrough, said insertion portion having a distal end and a proximal end;

a connector attached to said proximal end, said connector adapted to be connected to a feed line; and a check valve positioned in said passageway between said connector in said passageway and said distal end of said insertion portion, said check valve adapted to allow the flow of the repair compound through said passageway from said connector to said distal end and to prevent the flow of the repair compound through said passageway from said distal end to said connector.

11. The mechanical packer of claim 10 wherein said connector comprises a threaded region in said passageway at said distal end of said insertion portion, said threaded region adapted to threadingly engage a feed line.

12. The mechanical packer of claim 10 wherein said connector comprises an annular flange, said annular flange adapted to removably retain a feed line.

13. A method of repairing a damaged area of a concrete structure, the steps comprising:

(a) making a hole in the damaged area of the concrete structure;

(b) inserting a mechanical packer having a rigid insertion portion and a feed stem by positioning the insertion portion into engagement with the hole;

(c) injecting repair compound under external pressure through the mechanical packer and into said damaged area of the concrete structure until the repair compound in the damaged area is under sufficient pressure to permeate the damaged area; and (d) removing the external pressure on the repair compound while maintaining the pressure on the repair compound in the damaged area.

14. The method of claim 13 wherein the step of removing external pressure includes uncoupling the source of the repair compound from the mechanical packer.

15. The method of claim 13 wherein the step of removing external pressure includes breaking the feed stem off of the mechanical packer.

* * * * *